US005271330A

United States Patent [19]

Keller

[11] Patent Number: 5,271,330

[45] Date of Patent: Dec. 21, 1993

[54] OXYGEN ENHANCED CRUISE MISSILE WEAPON SYSTEM

[75] Inventor: Edward E. Keller, San Diego, Calif.

[73] Assignee: General Dynamics Corporation, Convair Division, San Diego, Calif.

[21] Appl. No.: 766,872

[22] Filed: Sep. 27, 1991

[51] Int. Cl.[5] ..... F42B 15/00

[52] U.S. Cl. ..... 102/374; 89/1.11; 102/473

[58] Field of Search ..... 89/1.11; 102/293, 374, 102/473, 491, 494, 495

[56] References Cited

U.S. PATENT DOCUMENTS

| | | | |
|---|---|---|---|
| 3,490,373 | 1/1970 | Fox | 102/488 |
| 3,572,249 | 3/1971 | Davis | 102/491 |
| 4,459,915 | 7/1984 | Lynch | 102/374 |

*Primary Examiner*—Charles T. Jordan

*Attorney, Agent, or Firm*—John R. Duncan; Frank D. Gilliam

[57] ABSTRACT

A major increase in terminal explosive energy of a missile by reacting bulk aluminum, titanium, magnesium, steel, and/or organic matrix composite missile structure with oxygen enriched air which is collected as the missile flies to its target. Oxygen rich air is produced from a small amount of engine bleed or atmospheric air processed through a molecular sieve on board oxygen generating system (OBOG), and stored under pressure in the missile fuel tanks as they are emptied during flight. Explosive reaction of the oxygen with missile structure is achieved with a flexible linear shaped charge (FLSC) attached to tank wall structure. Initiation of an explosive reaction between the bulk aluminum and oxygen can be achieved by a conventional shape charge or the like.

7 Claims, 2 Drawing Sheets

OXYGEN ENHANCED CRUISE MISSILE WEAPON SYSTEM

BACKGROUND OF THE INVENTION

The invention is directed to missile weapons and more particularly to increasing the explosive pay load of a missile.

Presently missile weapons depend on their explosive pay loads for target devastation and the missile structure itself serves no useful purpose except for delivering the pay load to a chosen target.

Presently, to achieve the destructive force desired from a given missile the delivery range is sacrificed to increase the payload size.

It would be highly desirable to increase the destructive power of the payload of a given missile and yet increase its range while substantially maintaining the same overall size.

The present invention makes this possible and further enhances the destructive delivery capabilities of the missile.

SUMMARY OF THE INVENTION

The invention is directed to increased payload and hence destructive capabilities of a missile. An onboard oxygen generator is carried by the missile. Engine bleed air or atmospheric air is processed onboard by a OBOG to generate oxygen enriched air. The oxygen enriched air is routed to the missile fuel tank under pressure and replaces fuel utilized during flight. An explosive charge (FLSC) is carried internal of the fuel tank and when the target is reached the charge is detonated. The detonation causes an explosive reaction between the oxygen enriched air in the tank and the material of tank construction. The firing of the explosive charge is substantially simultaneous with the explosion of the missile warhead payload.

An alternative is to release the pay load warhead on a first target and proceed to a second target with the enhanced missile.

In additions to missile applications, this invention has commercial applications where conventional explosives are customarily used. In these applications, an aluminum tube or container with FLSC attached to the interior is filled with oxygen from a concentrator or other source of at the point of use. By firing the FLSC, the explosive reaction between the bulk aluminum and the oxygen is initiated. The resulting energy is used to perform tasks in mining, construction, demolition, or other fields as required.

An object of this invention is to increase the terminal ballistic energy release of a given missile.

An other object of this invention is to increase the range of a given missile while maintaining substantially the same or greater terminal ballistic energy payload.

Other objects and features of the invention will become apparent as the drawings which follow are understood by reading the corresponding description thereof.

BRIEF DESCRIPTION OF THE DRAWING FIGURES

DETAILED DESCRIPTION OF THE PREFERRED EMBODIMENT OF THE INVENTION

Figure 1:
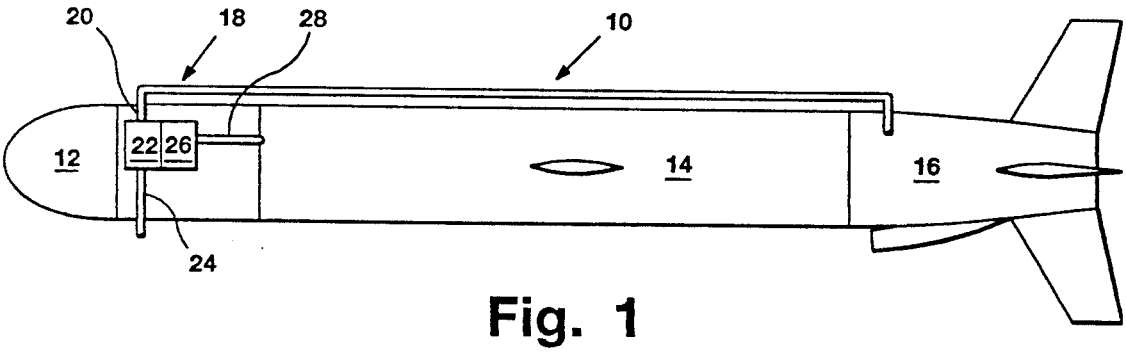
FIG. 1 is a schematic showing in cutaway not to scale of a missile incorporating the present invention.

Referring now to drawing FIG. 1 which depicts a non-scale schematic showing of a missile 10 generally of the cruise type including the payload warhead 12, fueling tank 14 capable of withstanding at least 600 lbs. of internal pressure, engine 16 and an onboard combination oxygen from air separator and pressure pump 18 for producing oxygen at about 600 lbs. per square inch (psi).

Bleed air from the engine is taken in through the input 20 to the separator portion 22 of the combination oxygen separator and pressure pump 18. The other elements separated from the air are dispensed back into the atmosphere via the vent 24. The oxygen about 70% pure produced by the separator 22 is pressurized to about 600 lbs. by the pressure pump 26 and fed into tank 14 through conduit 28. The air for the input 20 can be obtained either from engine 16 bled air if a turbine type engine is used to propel the missile or from the atmosphere. The fuel feed system from the tank to the engine is conventional and is not a part of this invention. The operation of the separator and compressor combination which would occupy about 1 $ft^3$ weighing less than 50 lbs. would decrease the efficiency of the engine only by about 1 to 2 %. The missile tail cone section could be modified to accommodate the combined separator/-compressor.

Figure 1A:
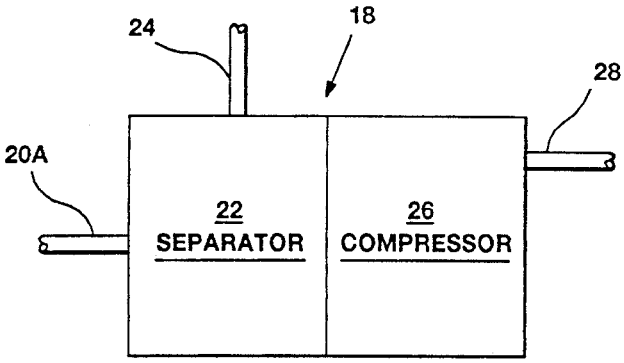
FIG. 1A is a showing of the oxygen generating system obtaining input air from the atmosphere.

It should be understood that the source of air for producing oxygen can also be obtained from the atmosphere as shown in drawing FIG. 1A.

Figure 2:
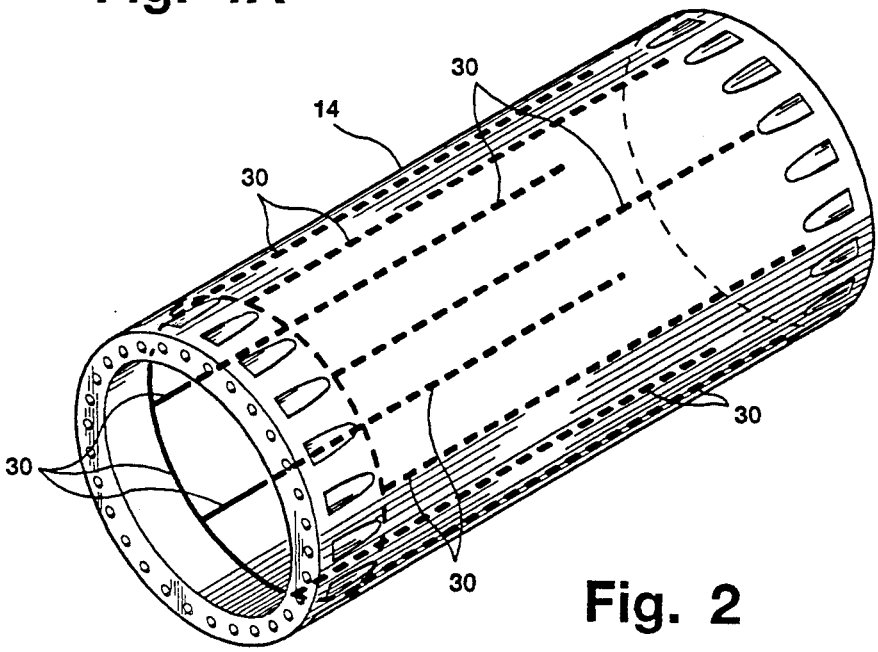
FIG. 2 is an elevated perspective showing a fuel tank employed in the present invention.

Referring now to drawing FIG. 2, the fuel tank 14 is shown with a plurality of explosive charges 30 partially in phantom linearly positioned along the inside surface of the tank. These charges 30 are detonated by any convenient means such as by way of example and not by way of limitation, a timer, radio transmitter and receiver combination, etc. The detonation of the explosive charges 30 is generally in conjunction with the missile reaching its target and the detonation of the missile warhead payload. The method and means for detonating the charges 30 is conventional and is not a part of this invention.

As the missile is propelled along it guided flight path, oxygen is separated from the air taken in at 20, pressurized by compressor 26 and fed into the fuel tank to replace the space left by the used fuel. When the missile reaches the end of its flight a considerable quantity of oxygen is now present in the fuel tank, as for example and not by way of limitation, approximately 50.6 lbs.

Referring now specifically to drawing FIGS. 3A through 3E. In drawing FIG. 3A the linear charges 30 totaling about 50 to 100 feet in length are positioned and attached to the inner surface 31 of the missile fuel tank 14. The tank is constructed of aluminum for the purpose of explanation. The charge 30 is generally attached with a non-reactive adhesive as for example, fluorosilicone material 32 or the like.

Figure 3A:
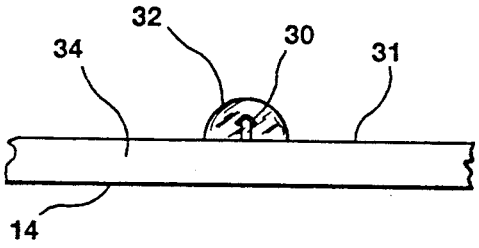
FIGS. 3A through 3E is a showing of the sequential placement and firing of a flexible linear shaped space charge within the fuel tank of a missile.
Figure 3B:
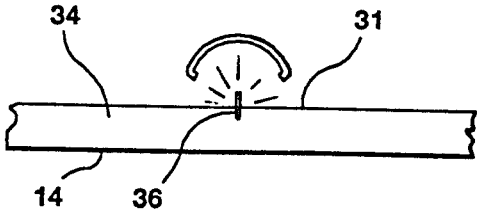
Figure 3C:
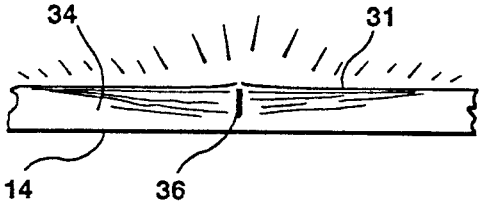
Figure 3D:
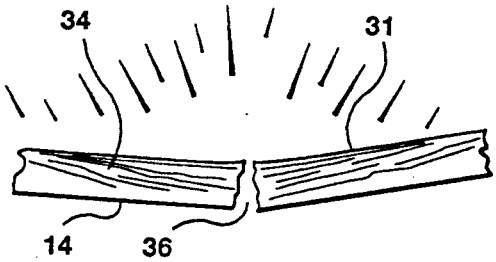
Figure 3E:
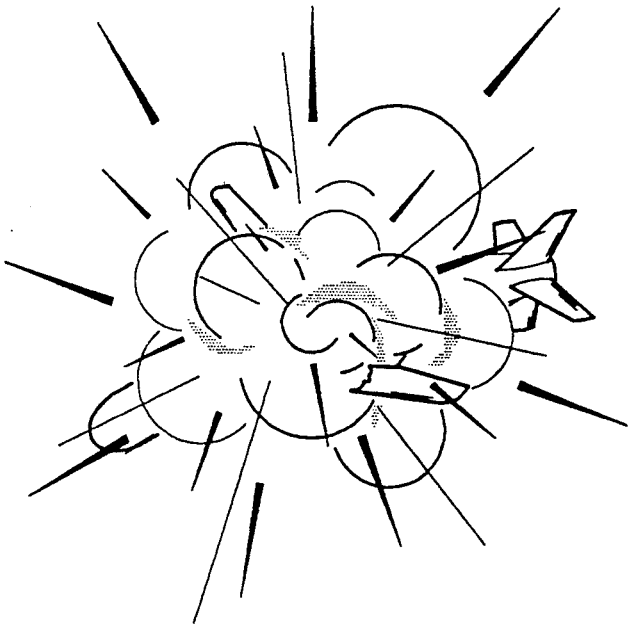

As the charges are detonated, as shown in drawing FIG. 3B, the wall 34 of the tank 14 ruptures generally along a line 36 where the liner charges are positioned.

The rupture of the wall 34 continues as the explosion of the linear charges detonates the oxygen in the tank and the aluminum tank material resulting in the dispersal of explosive energy and shrapnel from the tank walls not consumed in the reaction with the oxygen, see drawing FIGS. 3B through 3E.

An increase in missile range can be achieved by decreasing the size of the conventional warhead, replacing this gained volume in the missile with added fuel capacity. Overall explosive energy release at the target could be made equal to or greater than that achieved by the larger warhead alone and still significantly increase the missile range.

With a goal of doubling the explosive output of a 1000 lb. bomb with little increase in size of weight of a cruise missile, the following oxygen enhancement design is an example:

EXAMPLE 1

A 1000 lb. bomb has 361 lbs. of explosive, assuming TNT, with an explosive energy of $1.81 \times 10^5$ Kcal. The same amount of energy will be released by reacting 50.6 lbs. of oxygen with 56.9 lbs. of aluminum. The source of aluminum being as, aforementioned, the fuel tank structure. Unreacted tank structure will act as shrapnel, as aforementioned.

EXAMPLE 2

In a second example, with a goal of increasing the 1000 lb. bomb and increasing the missile range by 300 miles without decreasing the terminal energy release, replacing a 500 lb. bomb (3.5 $ft.^3$) for the 1000 lb. bomb (7.0 $ft.^3$) will result in an increased fuel capacity of 26.2 gal. Assuming a fuel consumption rate with a smaller bomb, i.e. warhead payload, of 12 miles Per gallon (MPG) of fuel, the range would be increased by 314 miles. Using the oxygen enhanced design in EXAMPLE 1 would give a total terminal energy release greater than with a conventional 1000 lb. bomb alone.

While a specific embodiment of the device of the present invention have been shown and fully explained above for the purpose of illustration it should be understood that many alterations, modifications and substitutions may be made to the instant invention disclosure without departing from the spirit and scope of the invention as defined by the appended claims.

What is claimed is:

1. An oxygen enhanced missile weapon system comprising:

means for providing a source of oxygen carried by said missile;

a fuel tank containing fuel for propelling said missile being suitable for containing said oxygen while under pressure;

means for pressurizing said oxygen and replacing the void space in said fuel tank left by utilized fuel by pressurized oxygen;

an explosive charge within said fuel tank, said fuel tank being constructed of a material which reacts with said oxygen when detonated whereby when said explosive charge is detonated the tank walls rupture creating explosive energy by the reaction of said oxygen and fuel tank construction material.

2. The oxygen enhanced missile weapon system as defined in claim 1 wherein said means for providing a source of oxygen is generated on board said missile.

3. The oxygen enhanced missile weapon system as defined in claim 1 wherein said fuel tank is constructed of aluminum.

4. The oxygen enhanced missile weapon system as defined in claim 1 wherein said means for pressurizing said oxygen is an onboard compressor.

5. The oxygen enhanced missile weapon system as defined in claim 1 wherein said oxygen is pressurized to a level of about 600 PSI.

6. The oxygen enhanced missile weapon system as defined in claim 1 wherein said explosive charge is a flexible linear shaped charge.

7. The oxygen enhanced missile weapon system as defined in claim 1 wherein all tank structure which does not react with said oxygen leaves said detonation as shrapnel.

* * * * *